US006062510A

United States Patent [19]

De La Melena

[11] Patent Number: 6,062,510

[45] Date of Patent: May 16, 2000

[54] KITE

[76] Inventor: Carlos De La Melena, Hernando De Soto 180, Maranga San Miguel, Lima, Peru

[21] Appl. No.: 09/406,189

[22] Filed: Sep. 27, 1999

[51] Int. Cl.[7] ..... B64L 31/06

[52] U.S. Cl. ..... 244/153 R; 244/155 A

[58] Field of Search ..... 244/153 R, 155 A

[56] References Cited

U.S. PATENT DOCUMENTS

| | | | |
|---|---|---|---|
| 5,064,150 | 11/1991 | Prouty | 244/155 R |
| 5,727,756 | 3/1998 | Rowe | 244/153 R |
| 5,938,150 | 8/1999 | King | 244/153 R |

*Primary Examiner*—J. Woodrow Eldred
*Attorney, Agent, or Firm*—Robert M. Downey, P.A.

[57] ABSTRACT

A kite includes an arrangement of elongate, flexible rods interconnected at one or more joints to define a frame structure. A primary tensioning system provides a reactive force, in response to a wind force exerted on the frame structure, to thereby increase frame rigidity and resistance against bending and breaking of the rods. Secondary tensioners absorb the wind force and provide resistance against deforming of the frame structure when under stress. A net, secured to the frame structure by the secondary tensioners, extends across a front face of the kite. The net, having an open weave construction, provides no resistance to wind forces. One or more panels, formed of a thin film material, such as lightweight fabric or plastic, are selectively and removably positionable on the front face, against the net; the panels being impervious to air flow and thereby defining a wind confronting surface for providing wind resistance. A handle, operated with one hand, includes three different positions to affix control lines of the kite, thereby providing adjustment of the speed and maneuverability of the kite in accordance with the skill of the user.

16 Claims, 8 Drawing Sheets

KITE

BACKGROUND OF THE INVENTION

1. Field of the Invention

The present invention is related to an improved kite construction and handheld control and, more specifically, to an improved kite which includes a net secured to the kite frame structure and one or more panels formed of a light fabric or plastic film, wherein the panels are selectively and removably positionable on the net to provide wind resistance. The kite further includes a control handle, operated with one hand, and including three different positions to affix control lines of the kite in order to enable adjustment of the responsiveness in the control of the speed and maneuverability of the kite in accordance with the skill of the person flying the kite.

2. Description of the Related Art

The construction of kites is well known and includes the use of rods, bridles, joints, a fabric or plastic film panel and lines extending from the kite to a handle for controlling movement of the kite through the air as the kite flies. The light fabric or plastic film panel on the front of the kite typically displays a design, character, or other image which can be seen from the ground while the kite is flying in air. The front panel is an integral part of the kite and, as such, cannot ordinarily be removed and interchanged with other panels. Moreover, the shape of the front panel is often dictated by the shape of the frame structure, and is thus limited to the specific frame structure style and configuration. This integral structure of the front panel and frame structure of the kite limits the usefulness of the kite, particularly for visual entertainment and advertising purposes. Furthermore, the control handle found on most kites is limited to a single level of control of the speed and maneuverability of the kite, so that a novice kite flyer experiences the same level of difficulty when flying the kite as an expert.

In view of the foregoing limitations associated with conventional kite construction, there is still a need in the kite art for an improved system of kite construction and flight control which facilitates versatility in the kite's appearance and adjustment of the responsiveness in the control of the speed and maneuverability of the kite in accordance with the skill of the person flying the kite. There is a further need for an improved kite construction which provides for primary tensioning means to increase rod resistance and rigidity in the frame structure.

SUMMARY OF THE INVENTION

The present invention is directed to a kite which includes an arrangement of elongate, flexible rods interconnected at one or more joints to define a frame structure. A primary tensioning system provides a reactive force, in response to a wind force exerted on the frame structure, to thereby increase frame rigidity and resistance against bending and breaking of the rods. Secondary tensioners absorb the wind force and provide resistance against deforming of the frame structure when under stress. A net, secured to the frame structure by the secondary tensioners, extends across a front face of the kite. The net, having an open weave construction, provides no resistance to wind forces. One or more panels, formed of a film material, are selectively and removably positionable on the front face, against the net; the panels being impervious to air flow and thereby defining a wind confronting surface for providing wind resistance. A handle, operated with one hand, includes three different positions to affix control lines of the kite, thereby providing adjustment of the responsiveness in the control of the speed and maneuverability of the kite in accordance with the skill of the user.

With the foregoing in mind, it is a primary object of the present invention to provide an improved system of kite construction which provides tensioners in the rear section of the kite to increase rod resistance and rigidity, wherein the tensioners are responsive to a wind force exerted on the frame structure, thereby increasing frame rigidity and resistance against bending and breaking of the rods of the kite's frame structure.

It is a further object of the present invention to provide an improved system of kite construction including secondary tensioners structured and disposed to adsorb the wind force on the kite and to provide resistance against deforming of the frame structure.

It is still a further object of the present invention to provide an improved system of kite construction, wherein the kite's front section is fitted with a net having an open weave construction which does not provide wind resistance.

It is yet a further object of the present invention to provide an improved system of kite construction, wherein the net of the kite's front section is specifically structured and disposed to support one or more light fabric or plastic film panels thereon, and wherein the one or more panels are removably held on the net, and not as an integral part of the kite, and further wherein the panels are structured and disposed to provide wind resistance to facilitate flying of the kite.

It is still a further object of the present invention to provide an improved system of kite construction, wherein the one or more light fabric or plastic film panels placed on the net can be easily removed and interchanged with other panels.

It is still a further object of the present invention to provide an improved system of kite construction, wherein the one or more removable and interchangeable light fabric or plastic panels are useful for advertising or publicity means.

It is yet a further object of the present invention to provide a kite having an improved control stick which is operable with the use of one hand, and wherein the control stick includes a plurality of positions for affixing control lines of the kite, to thereby provide adjustment of the control of the speed and maneuverability of the kite in accordance with the skill of the user.

It is still a further object of the present invention to provide an improved control stick for flying a kite which includes three different positions to affix the four control lines of the kite, and wherein the control stick is structured to be operated by one hand.

It is yet a further object of the present invention to provide a kite which does not require the use of a bridle on the front section.

These and other objects and advantages of the present invention will be readily apparent with reference to the following detailed description and the accompanying drawings.

BRIEF DESCRIPTION OF THE DRAWINGS

For a fuller understanding of the nature of the present invention, reference should be had to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
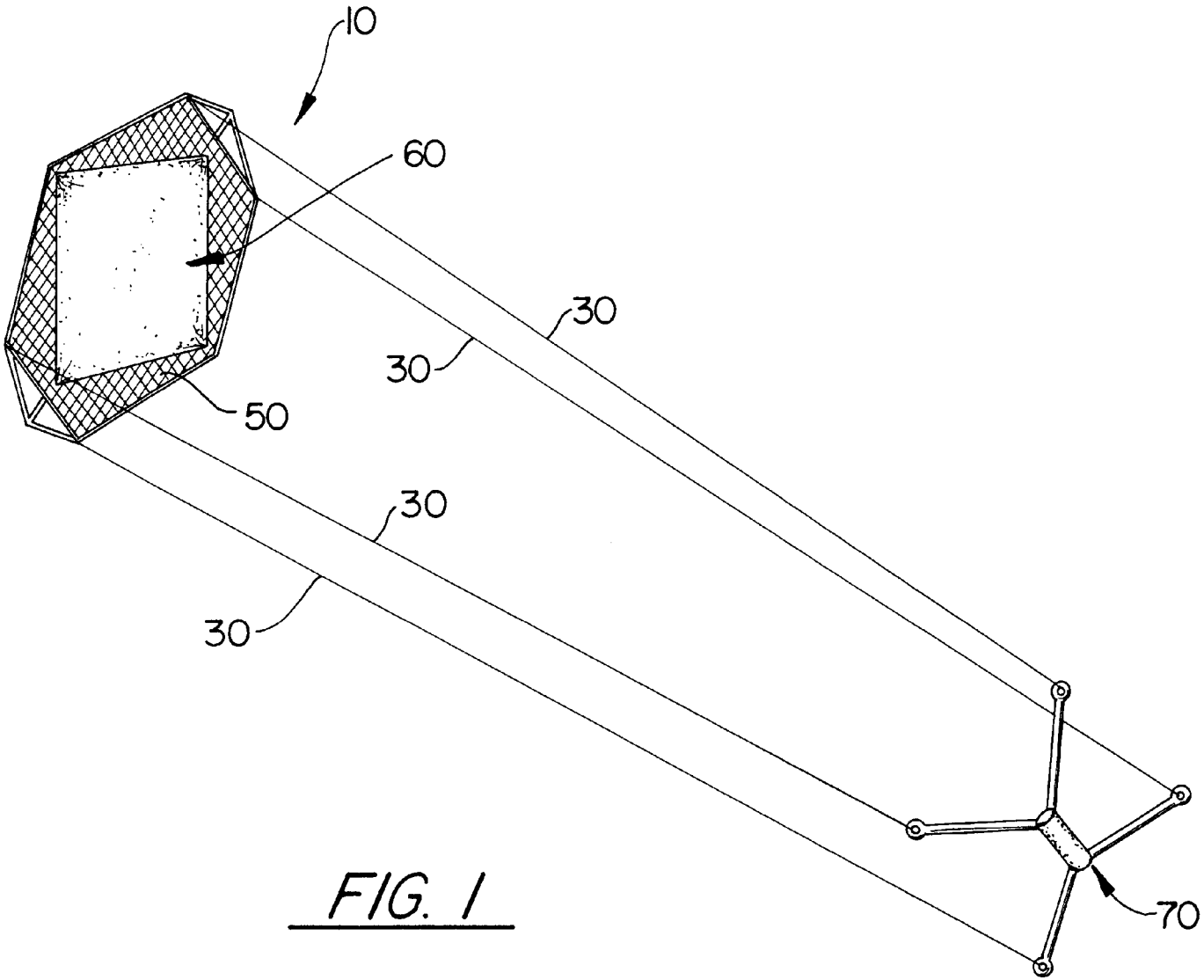
FIG. 1 is a perspective view showing the kite and control handle, with the four control lines extending from the kite to the control handle, illustrating the general manner of flight of the kite.

Referring to the several views of the drawings, and initially FIGS. 1–4, the kite of the present invention is shown and is generally indicated as 10. The kite 10 includes a frame structure 12 having a front side and a rear side. The frame structure is comprised of a plurality of elongate rods 14 which are interconnected at proximal ends 16 to one or more joints 18. An opposite distal end 20 of each of the rods is fitted with an end cap 22 which may include an eyelet or other means thereon to facilitate tying or securing of one or more tensioning lines thereto.

The kite of the present invention uses a novel system of construction which includes the use of primary tensioning means and secondary tensioning means on the rear side of the frame structure for exerting tension on the rods of the frame structure in order to increase its resistance and rigidity so that the frame structure may withstand the wind force exerted on the front side. The rigidity provided by the primary and secondary tensioning means prevents the rods from bending excessively and breaking. More specifically, the primary tensioning means transmits a reactive force to the center and end of the rods which is equal and opposite to the force produced by the wind. This opposite force produced by the tensioning means is in accordance with the law of physics which states that every action has an equal and opposite reaction.

Figure 2:
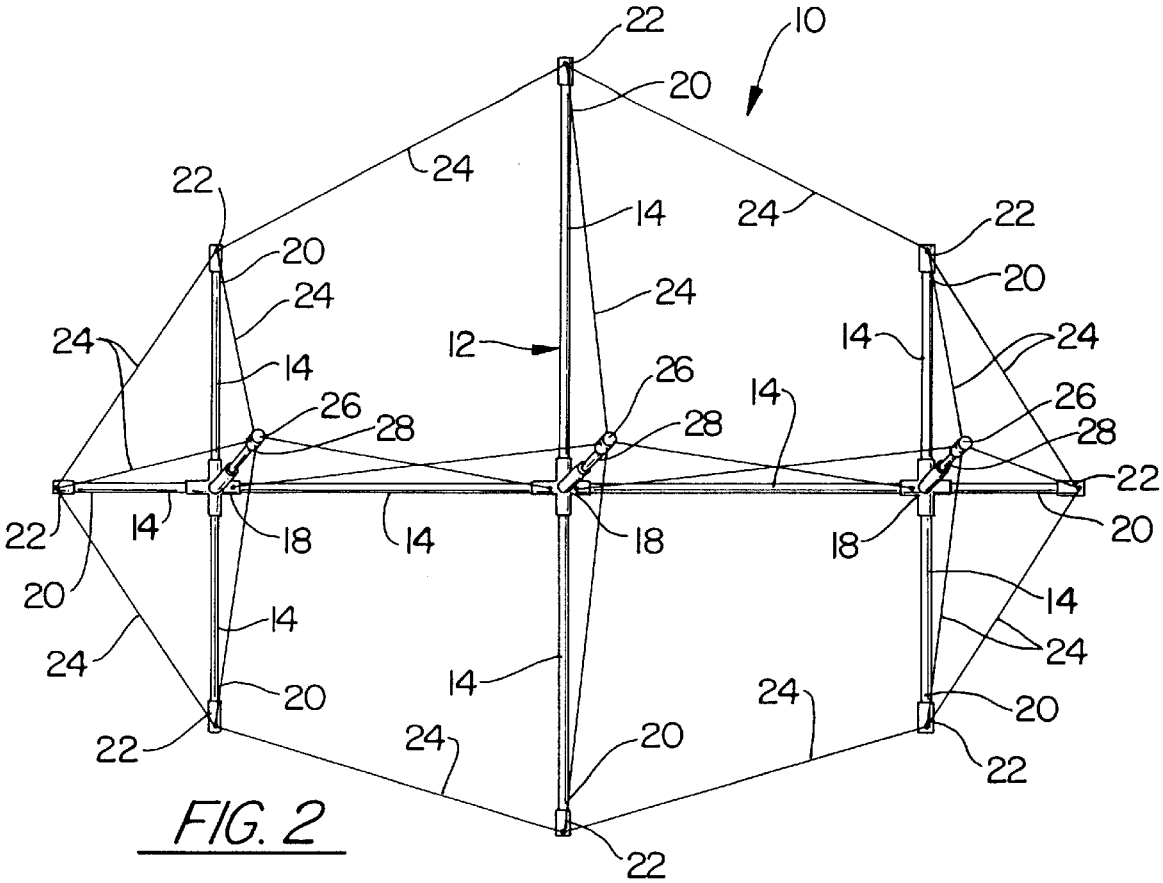
FIG. 2 is a rear perspective view of the frame structure and primary tensioning means of the kite.
Figure 3:
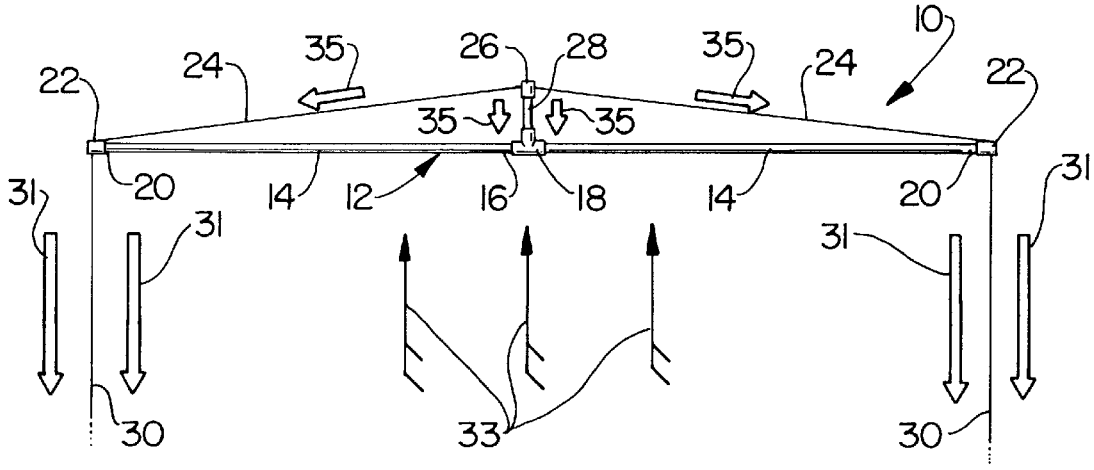
FIG. 3 is a side elevation of the kite's frame structure illustrating wind forces acting thereon and reactive forces created by the primary tensioning means to provide rigidity to the frame structure and resistance against bending.

Referring to FIGS. 2 and 3, the primary tensioning means includes tensioning lines 24 connecting to the fitting 22 on the distal ends 20 of the rods and a rear distal end 26 of a rearwardly directed stiffening stem member 28 fitted to each of the joints 18 and extending perpendicularly to the plane of the frame structure on the rear side. Referring to FIG. 3, the forces acting on the frame structure are shown, wherein the control lines 30 (a total of four) extending from the fittings 22 at the distal ends of the rod, at select locations on the frame structure, exert a force in the direction of the arrows 31. As the kite is flying, a wind force, indicated by arrows 33, exerts a force on the front face of the frame structure. A reactive force created by the primary tensioning means, in response to the wind force 33, is indicated by arrows 35. Specifically, the wind force 33 transmitted through the frame structure results in a stretching or pulling of the tensioning lines 24 in the direction of arrows 35 towards the ends 20 of the rods and inwardly at the joints, transmitted through the stiffening of stem member 28. This reactive force prevents the rods of the frame structure from bending excessively and splitting or breaking.

Figure 4:
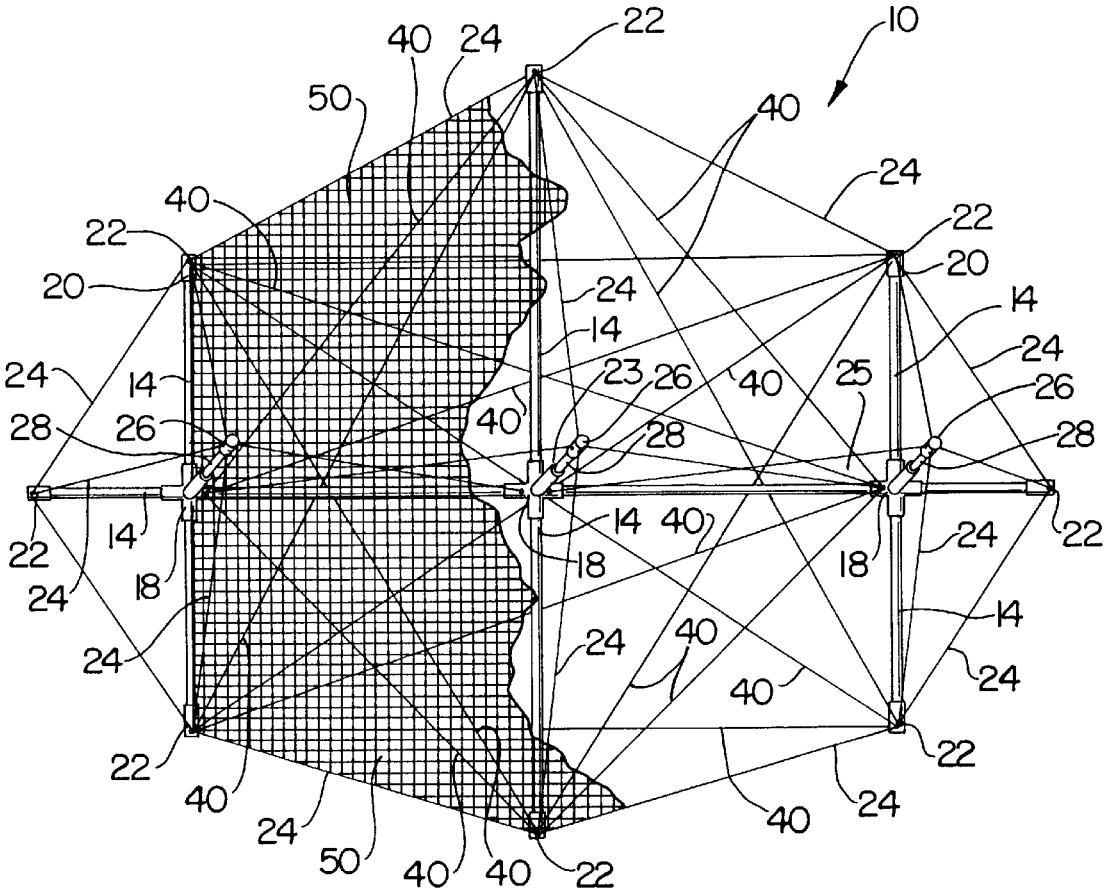
FIG. 4 is a front perspective view of the kite showing the net, in partial cutaway, secured to the frame structure using the secondary tensioning lines.
Figure 5:
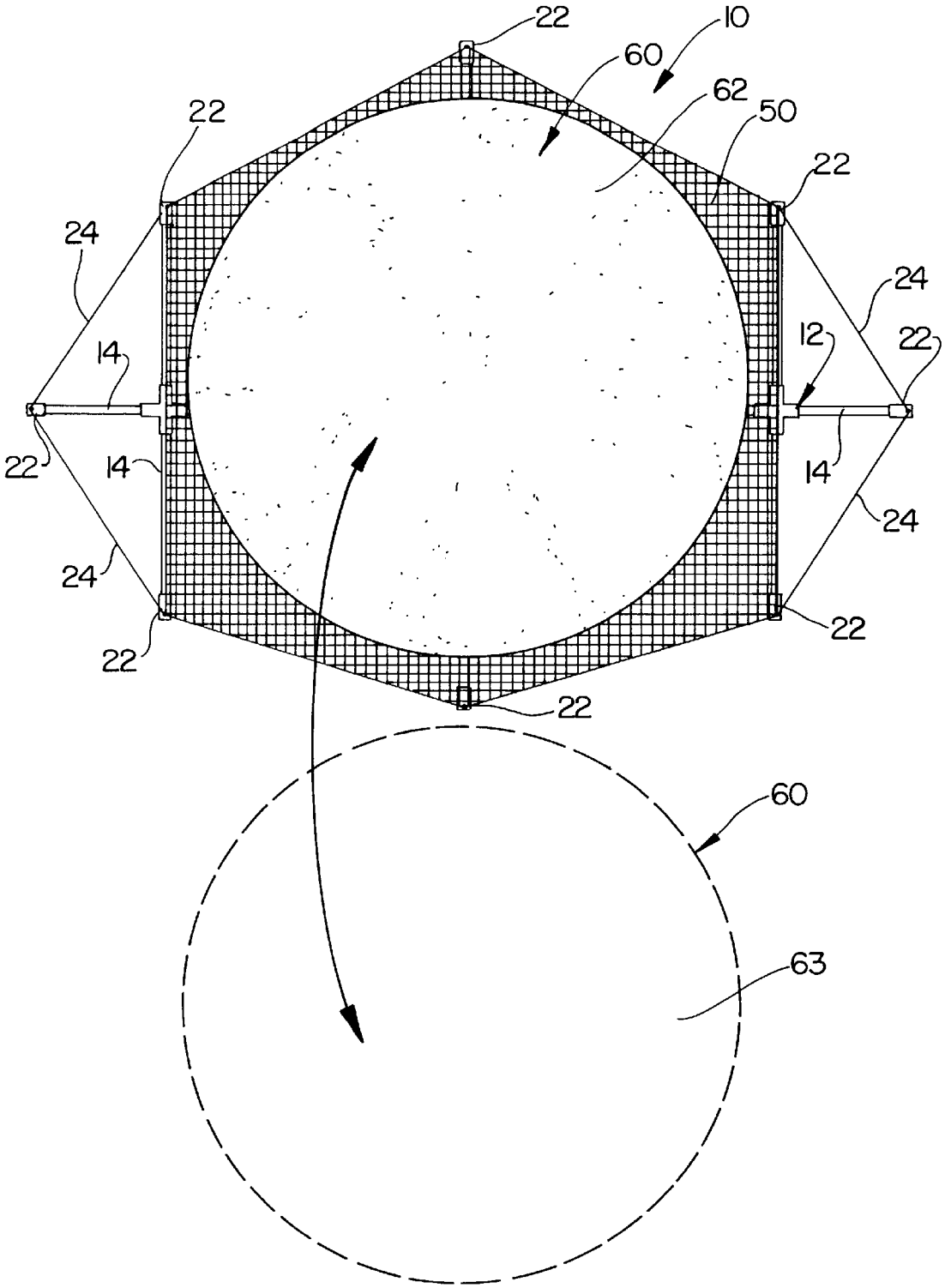
FIG. 5 is a front elevational view showing the placement of an interchangeable panel on the net to thereby provide a wind confronting surface for creating wind resistance.
Figure 6A:
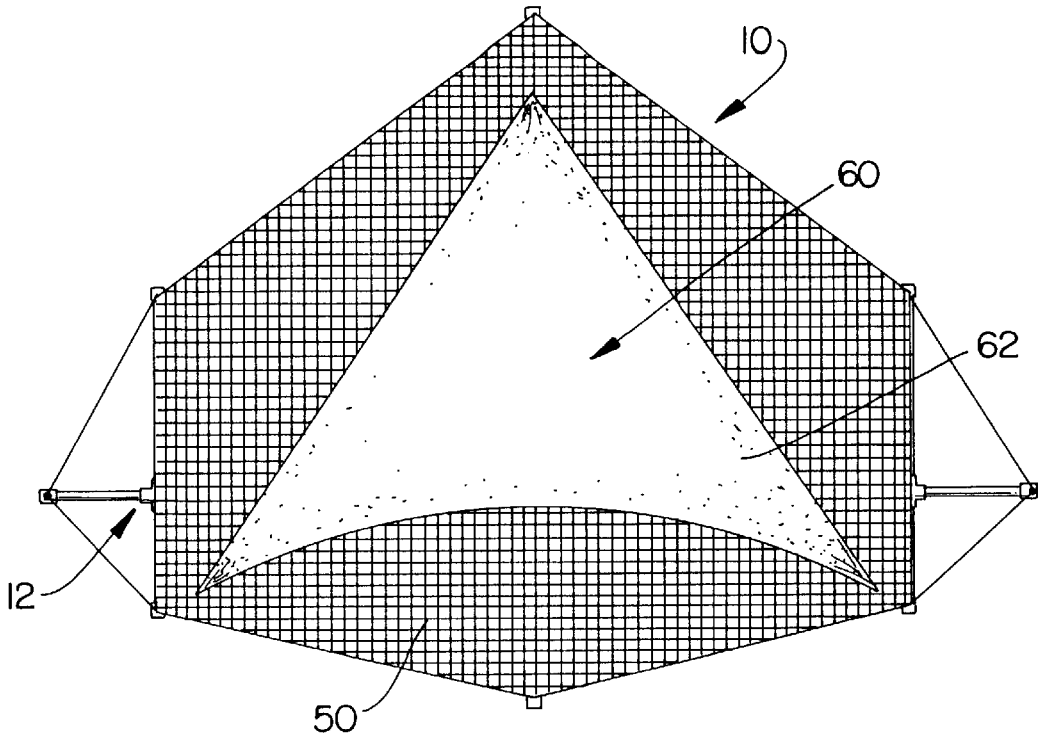
FIGS. 6A and 6B are front elevational views showing interchangeable wind resistance panels of various configurations placed on the net of the kite's front face.
Figure 6B:
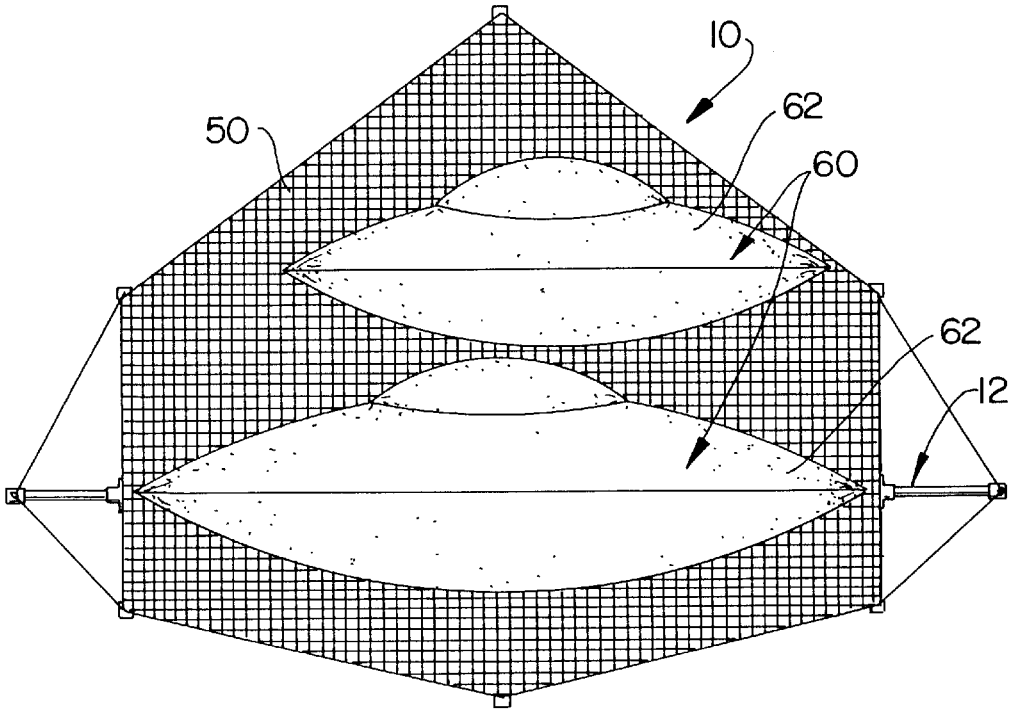

Referring to FIG. 4, the secondary tensioning means is shown. Specifically, the secondary tensioning means includes a plurality of tensioning lines 40 interconnected to and extending between the ends of the rods, including between the fittings 22 as well as between the fittings 22 and the joints. The tensioning lines 40 extend along the plane of the frame structure to further define a front and rear face. The secondary tensioning means fulfills the same general function as the primary tensioning means but acts upon the frame structure so as to maintain its rigidity and discourage deforming of the frame structure when subjected to stress of the wind forces. The secondary tensioning means further serves to fix a net 50 on the front side of the frame structure, further defining the front face. The net 50 is of an open weave construction and is specifically structured to permit air flow therethrough, thereby providing practically no wind resistance. The net 50 is structured and disposed to provide a support means on the front face of the kite to accommodate one or more wind resistant surfaces thereon. More specifically, the wind resistant surfaces are provided in the form of a thin, lightweight fabric or plastic film material panel 60. One or more of the panels 60, providing a wind resistant surface on the front face of the kite, may be placed on the net. Specifically, the panels 60 each include a front flat side 62 and a rear flat side 63. The panels are placed on the net with the rear side 63 against the net, so that the front side 62 defines a wind confronting surface. The panels are releasably held against the net by the wind force exerted on the front of the frame structure, and against the front side 62 of the panels. It should be noted that the panels may be provided in any desired shape or configuration, with printing or graphics thereon. For instance, the panels may be provided in the form of space ships, as seen in FIG. 6B. Or, alternatively, a geometric shape, as seen in FIGS. 5 and 6A. Virtually any desired shape or design can be used. Further, the front side 62, as well as the rear side 63, may be provided with advertising indicia thereon which is visible from the ground while the kite is being flown. The panels 60 are easily interchanged so that the appearance of the kite may be quickly altered. Further, the removable and interchanging capabilities of the panels facilitates quick and efficient changing of advertisement messages so that a plurality of advertisements may be displayed by the same kite and changed each time the kite is flown.

Figure 8:
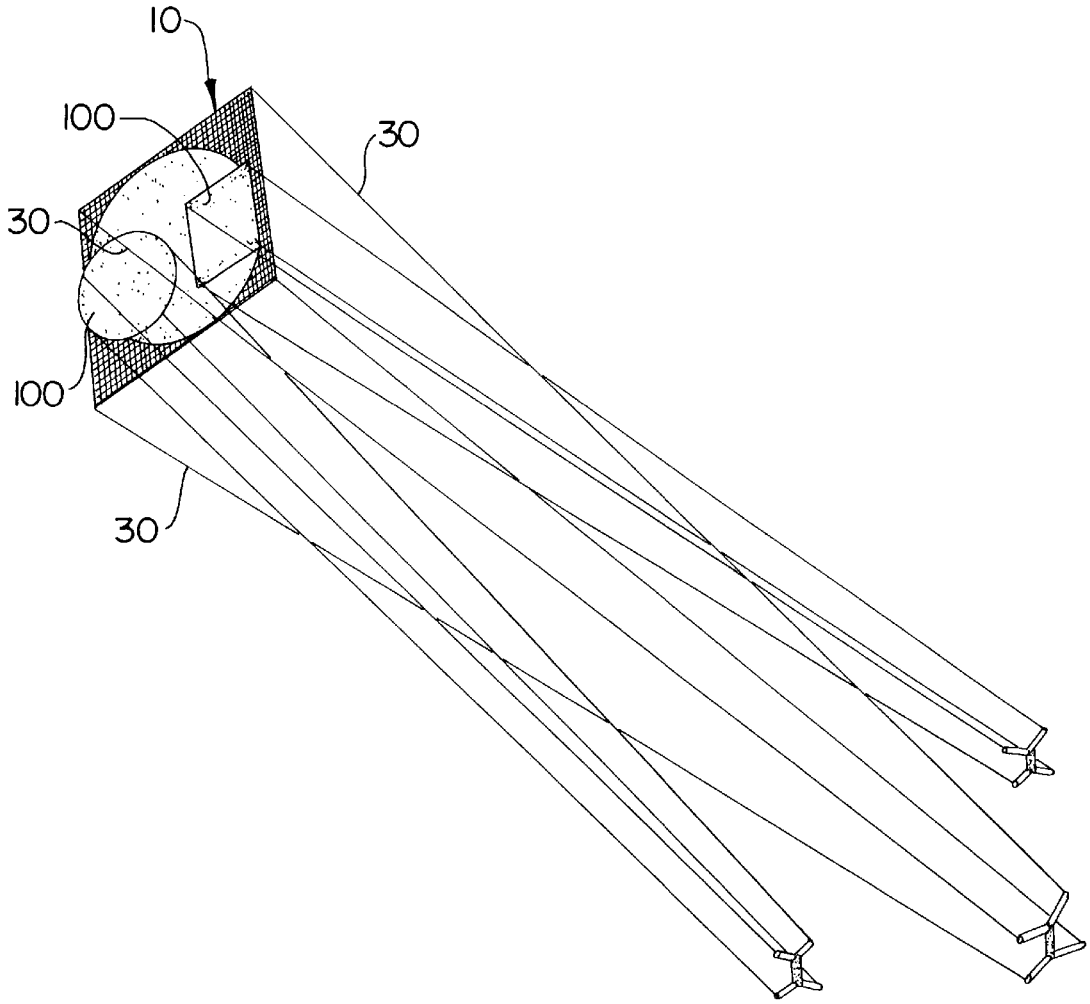
FIG. 8 is a perspective view showing the kite of the present invention with two other kites landed on the net of the kite while in flight.

The structure of the kite further facilitates placement of other kites against the front face, as seen in FIG. 8. In this instance, the kite 10 acts as an auxiliary ship, with one or more other kites 100 carried on the front face, against the net. Thus, the kite 10 may carry one or more of the kites 100, which may align in full flight upon the front face of the kite 10. Further, the kite 10 may take off with the other kites 100 thereon, or, alternatively, the kites 100 may be moved into position against the front face of the kite 10 while the kites 10 and 100 are in flight. The kites 100 may further be separated by pulling away from the front face of the kite 10 and moving the kites 100 outboard of the kite 10 so that they cleanly separate without entangling with the control lines 30.

Figure 7:
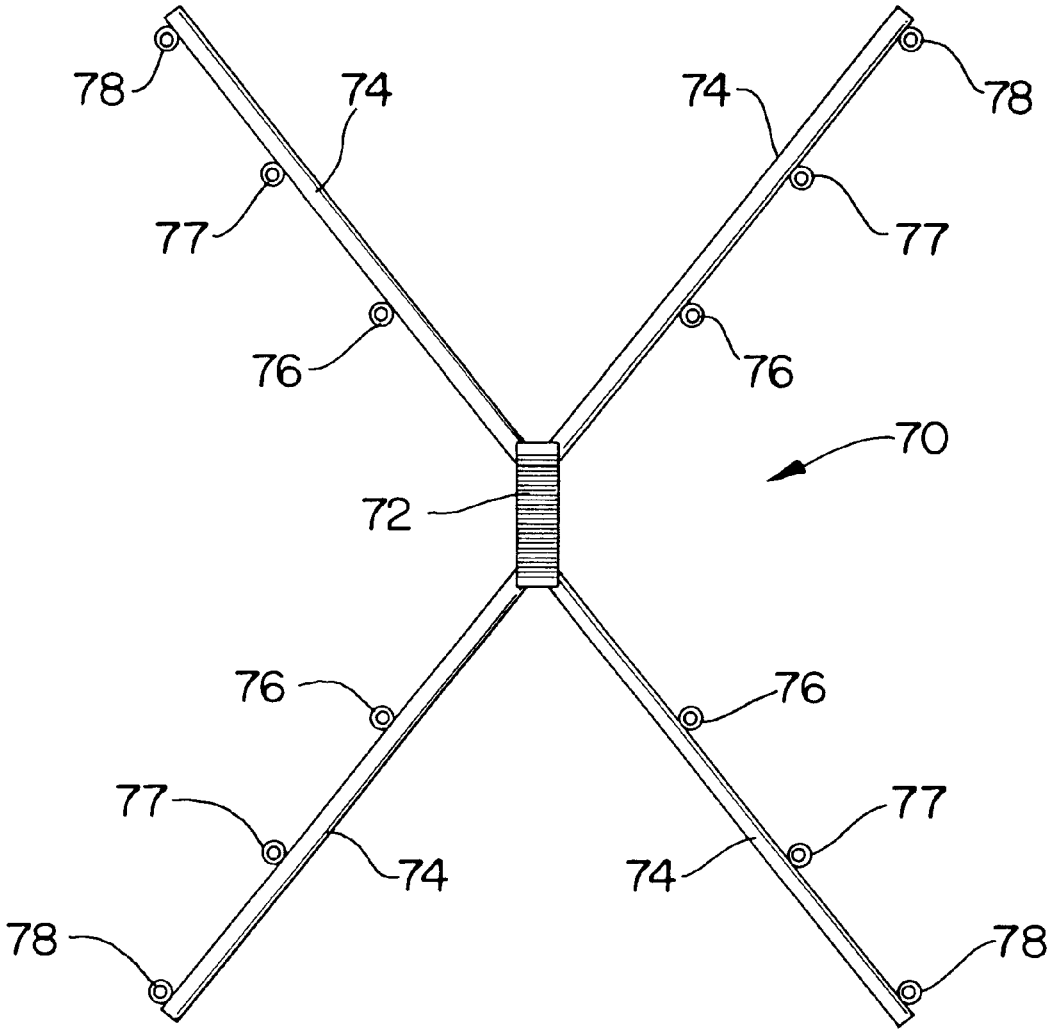
FIG. 7 is a front elevational view of the control stick of the present invention.

The kite 10 further includes a control stick 70 which is specifically structured to allow the kite 10 to be flown by a professional (expert), an amateur, or a beginner. The control stick 70 includes a central handle 72 which is designed to be grasped by one hand. Four arm members 74 extend outwardly from the central handle 72 so that the control stick 70 has a generally X configuration, as best seen in FIG. 7. Each of the arm members 74 are fitted with three separate line attachment members 76, 77 and 78. The attachment members 76, 77 and 78 define three different control positions for attachment of the control lines 30 to the control stick 70. Specifically, the first set of line attachment members 76 define a beginner position. The middle attachment members 77 define an intermediate or amateur position. Finally, the outermost line attachment members 78 define a professional or expert position. Each of the selected positions for attachment of the control lines to the arm members of the control stick provide a distinct degree of control of the speed of movement of the kite through the air upon manipulating the handle with one hand. Thus, the different attachment positions provide means for adjusting the responsiveness in the control of the speed and maneuverability of the kite in accordance with the skill of the user.

Figure 9A:
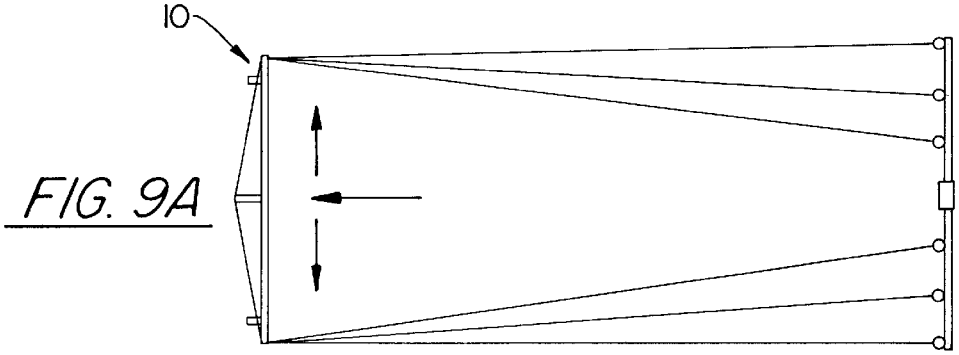
FIGS. 9A–9D illustrate variations in the degree of control of the kite in accordance with three different control line positions on the control stick, and wherein the control stick in FIGS. 9B–9D is shown positioned at the same angle while the kite is variably positioned in accordance with the location of attachment of the lines to the control stick.
Figure 9B:
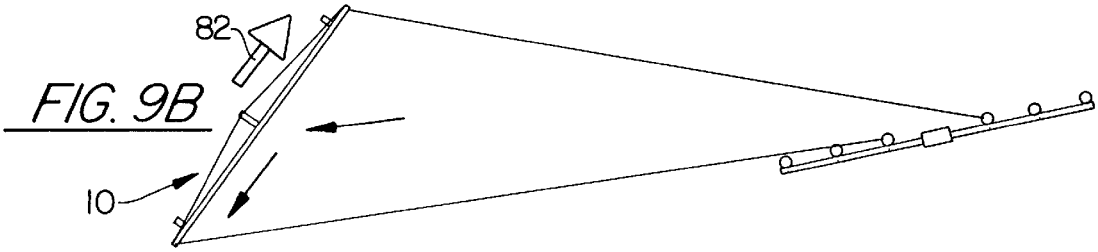
Figure 9C:
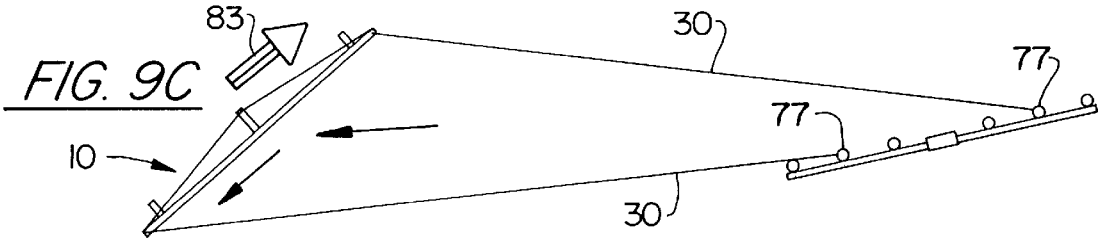
Figure 9D:
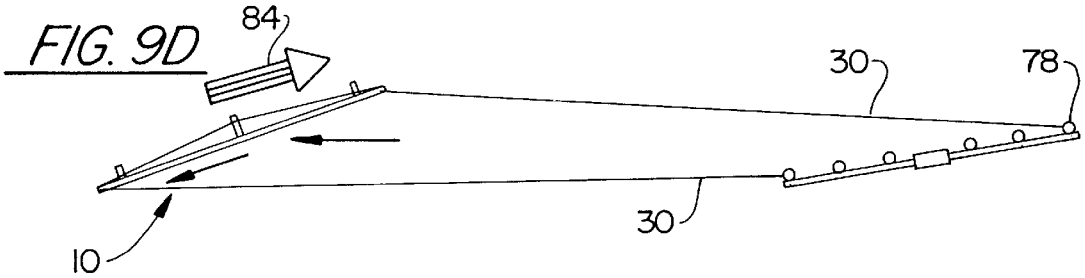

Referring to FIGS. 9A–9D, the difference in the degree of control and speed of movement of the kite is shown with the attachment of the control lines 30 to the different positions on the control stick 70. In particular, FIG. 9A shows the first position of the control stick, wherein the arm members are maintained generally parallel with the plane of the kite frame structure. In this position, the forces acting on the kite are the same at each of the control positions. Up on moving the control stick to an angle, such as that shown in FIGS. 9B–9D, the level or amount of control changes depending up on the position at which the control lines are attached to the control stick. Specifically, FIGS. 9B–9D illustrate the difference in the level of control while the control stick 70 is maintained at the same angle (approximately 80°). In FIG. 9B, the control lines 30 are attached at the first control position (beginner) 76, wherein the kite's frame structure has been moved, from the position shown in FIG. 9A, to generate a first speed of the kite, as seen by arrow 82. Next, in FIG. 9C, the control lines 30 are connected at the intermediate position 77, and the control stick is maintained at the same angle as in FIG. 9B, but the kite frame structure has been moved further than that of FIG. 9B, thus increasing the speed as indicated by arrow 83. Finally, in FIG. 9D, the control lines 30 are attached at the outermost (expert) control positions 78 on the control stick 70 so that the kite's frame structure is moved in the most dramatic manner to create the highest speed and maneuverability as indicated by arrow 84.

While the instant invention has been shown and described in accordance with a preferred and practical embodiment thereof, it is recognized that departures may be made from the instant disclosure and, thus, the scope of the present invention is not to be limited except as defined within the following claims as interpreted under the doctrine of equivalents.

What is claimed is:

1. A kite comprising:

a frame structure having a front side and a rear side and including:

a plurality of elongate rods each including a distal end and a proximal end; and at least one joint for interconnecting said proximal ends of said plurality of rods to thereby facilitate assembly of said frame structure;

primary tensioning means for stiffening said frame structure and for increasing resistance against bending and breaking of said plurality of rods when said frame structure is subjected to a wind force;

secondary tensioning means for absorbing the wind force exerted on said frame structure, thereby providing resistance to deforming of said frame structure when under stress;

a net fixed to said front side of said frame structure and defining a front face of said kite, said net being structured and disposed to air flow therethrough, thereby providing minimal wind resistance;

at least one panel formed of a film material and including a front side and a rear side, said at least one panel being removably positionable on said front face, with said rear side against said net, to thereby define a wind confronting surface on said front face of said kite and said at least one panel being releasably held against said net by the wind force exerted on said front side of said frame structure;

a plurality of control lines attached to and extending from said frame structure; and a handle including means for attaching said plurality of control lines thereto at any of a plurality of selected positions, wherein each of said plurality of selected positions provides a distinct degree of control of the speed of movement of the kite through the air upon manipulating the handle with one hand, thereby providing means for adjusting the responsiveness in the control of the speed and maneuverability of the kite in accordance with the skill of the user.

2. The kite as recited in claim 1 wherein said primary tensioning means includes:

a stem member fitted to each of said joints and extending rearwardly from the rear side of said frame structure in perpendicular relation to said rods and including a rear distal end;

a plurality of tensioning lines extending and connecting between the distal ends of said rods, about a periphery of said frame structure and said tensioning lines further extending from said distal ends of said rods to said rear distal end of said stem member at said at least one joint; and said tensioning lines and said stem member being structured to exert a reactive, opposite force to said at least one joint and said distal ends of the rods in response to a wind force exerted on the front side of said frame structure.

3. The kite as recited in claim 2 wherein said secondary tensioning means includes a plurality of tensioning lines connecting to and extending diagonally between said distal ends of said rods and said at least one joint, and said tensioning lines of said secondary tensioning means being co-planar with said front face.

4. The kite as recited in claim 3 wherein said tensioning lines of said secondary tensioning means are structured and disposed to attach said net to said frame structure.

5. The kite as recited in claim 1 wherein a plurality of said panels are provided, each being of a different size and shape.

6. The kite as recited in claim 5 wherein one or more said plurality of panels are removably positionable on said front face, against said net.

7. The kite as recited in claim 1 wherein said kite includes four of said control lines.

8. The kite as recited in claim 7 wherein said means for attaching said plurality of control lines to said handle includes three of said selected positions including a beginner position, an intermediate position, and an expert position.

9. The kite as recited in claim 1 wherein said at least one panel includes indicia thereon.

10. The kite as recited in claim 9 wherein said indicia on said at least one panel includes advertising indicia.

11. The kite as recited in claim 1 wherein said frame structure is provided in a plurality of select configurations including a select number of said elongate rods and one or more of said joints in accordance with the desired frame configuration selected by the user.

12. A kite comprising:

a frame structure having a front side and a rear side and including:

a plurality of elongate rods each including a distal end and a proximal end; and at least one joint for interconnecting said proximal ends of said plurality of rods to thereby facilitate assembly of said frame structure;

primary tensioning means for stiffening said frame structure and for increasing resistance against bending and breaking of said plurality of rods when said frame structure is subjected to a wind force;

secondary tensioning means for absorbing the wind force exerted on said frame structure, thereby providing resistance to deforming of said frame structure when under stress;

a net fixed to said front side of said frame structure and defining a front face of said kite, said net being structured and disposed to air flow therethrough, thereby providing minimal wind resistance;

at least one panel formed of a film material and including a front side and a rear side, said at least one panel being removably positionable on said front face, with said rear side against said net, to thereby define a wind confronting surface on said front face of said kite and said at least one panel being releasably held against said net by the wind force exerted on said front side of said frame structure;

a plurality of control lines attached to and extending from said frame structure; and a handle including means for attaching said plurality of control lines thereto.

13. The kite as recited in claim 12 wherein said means for attaching said plurality of control lines to said handle includes a plurality of selected positions for attaching said control lines to said handle, wherein each of said plurality of selected positions provides a distinct degree of control of the speed of movement of the kite through the air upon manipulating the handle with one hand, thereby providing means for adjusting the responsiveness in the control of the speed and maneuverability of the kite in accordance with the skill of the user.

14. The kite as recited in claim 13 wherein said primary tensioning means includes:

a stem member fitted to each of said joints and extending rearwardly from the rear side of said frame structure in perpendicular relation to said rods and including a rear distal end;

a plurality of tensioning lines extending and connecting between the distal ends of said rods, about a periphery of said frame structure and said tensioning lines further extending from said distal ends of said rods to said rear distal end of said stem member at said at least one joint; and said tensioning lines and said stem member being structured to exert a reactive, opposite force to said at least one joint and said distal ends of the rods in response to a wind force exerted on the front side of said frame structure.

15. The kite as recited in claim 14 wherein said secondary tensioning means includes a plurality of tensioning lines connecting to and extending diagonally between said distal ends of said rods and said at least one joint, and said tensioning lines of said secondary tensioning means being co-planar with said front face.

16. The kite as recited in claim 15 wherein said tensioning lines of said secondary tensioning means are structured and disposed to attach said net to said frame structure.

* * * * *